US005983585A

United States Patent [19]

Spakousky

[11] Patent Number: 5,983,585

[45] Date of Patent: Nov. 16, 1999

[54] BUILDING BLOCK WITH INSULATING CENTER PORTION

[76] Inventor: John Spakousky, P.O. Box 3656, Soldotna, Ak. 99669

[21] Appl. No.: 08/795,691

[22] Filed: Feb. 4, 1997

[51] Int. Cl.[6] ..... E04B 2/32; E04B 1/78

[52] U.S. Cl. ..... 52/405.4; 52/405.1; 52/424; 52/426; 52/431; 52/564; 52/568; 52/565; 52/590.2

[58] Field of Search ..... 52/425, 424, 428, 52/426, 596, 564, 563, 589, 309.11, 606, 378, 379, 405.1, 405.2, 405.4, 427, 565, 568, 590.1, 590.2, 431

[56] References Cited

U.S. PATENT DOCUMENTS

| | | | |
|---|---|---|---|
| 994,027 | 5/1911 | O'Beirne | 52/568 X |
| 1,226,214 | 5/1917 | Hopkins | 52/568 X |
| 1,567,430 | 12/1925 | Eberling | 52/606 |
| 2,134,894 | 11/1938 | Schubert | 52/568 |
| 2,172,052 | 9/1939 | Robbins | 52/606 |
| 2,326,361 | 8/1943 | Jacobsen | 52/568 X |
| 4,180,956 | 1/1980 | Gross | 52/563 X |
| 4,802,318 | 2/1989 | Snitovski | 52/405.1 X |
| 4,982,544 | 1/1991 | Smith | 52/606 |
| 5,086,600 | 2/1992 | Holland et al. | 52/564 X |
| 5,193,318 | 3/1993 | D'Antonio et al. | 52/606 X |
| 5,337,530 | 8/1994 | Beames | 52/426 |
| 5,379,565 | 1/1995 | Vienne | 52/606 |
| 5,560,167 | 10/1996 | Miceli | 52/568 X |
| 5,570,552 | 11/1996 | Nehring | 52/426 |
| 5,657,600 | 8/1997 | Mensen | 52/426 |
| 5,845,448 | 12/1998 | Potvin | 52/568 X |

*Primary Examiner*—Robert Canfield
*Attorney, Agent, or Firm*—Dorsey & Whitney LLP

[57] ABSTRACT

A building block that has two block walls joined by plastic webs. The block walls can be made of cement, clay brick, or similar materials. The block has the strength of a cinder block, but with much less weight. Moreover, the plastic webs are used as a handle to permit easy handling and placement of the blocks. Because of the thermal characteristics of the plastic webs, when a wall is finished using these blocks, it has the characteristics of a true double wall construction. The blocks are filled with concrete on one side of the block and filled with insulation on the other side of the center arm. This creates a structurally sound wall that is fully insulated. The blocks come in full-height, half-height, full-length and half-length sizes. There is also a corner unit design.

30 Claims, 14 Drawing Sheets

BUILDING BLOCK WITH INSULATING CENTER PORTION

This invention relates to building blocks and particularly to building blocks having plastic inserts therein to permit insulation to be placed within the blocks to act as a thermal barrier through the block.

BACKGROUND OF THE INVENTION

Building blocks have developed over time. Originally, solid bricks were used. These evolved into cinder blocks. These blocks are formed of concrete and have pair of holes formed through the blocks. These holes make the blocks considerably lighter, and can be used as a better handle to help carry and position the blocks, and a space within the block to hold reinforcing bar and to be filled with concrete once the blocks are placed. The basic cinder block has changed little over time. However, new blocks have been developed to make construction more flexible. For example, blocks today are curved, they have different structural configurations, and are even made of light weight plastic foam.

A number of blocks were developed to better insulate block walls. A normal cinder block th at is filled with cement has no space for insulating material. Although the blocks do provide some insulating properties, such blocks are best known as heat absorbers. Thus, a block wall absorbs heat in the summer and holds that heat, which causes an increased cooling load. Similarly, in winter, they absorb cold, increasing the heating load. To solve this problem, several blocks have been developed to allow for insulative material to be placed within the blocks, thereby breaking the thermal flow paths. Examples of these blocks are found in the following U.S. Patents. U.S. Pat. No. 3,593,480 teaches a block that has an outer appearance that is similar to an ordinary cinder block. The block is actually a plastic shell that has cavities that are filled with concrete. The block also has open areas that can be either dead air space or can be filled with insulating material. The problem with these blocks is that they must be filled with concrete, and the concrete must be cured, before they can be set into place. Once filled, these blocks become heavy and are difficult to work with. U.S. Pat. No. 4,380,887 to Lee teaches a cinder block that is made with special slots that allow foam insulation panels to be inserted into the slots. The idea is to break up the thermal conductivity through the block webs. Although this design is an improvement, it still requires a full size block, with all the weight problems associated with that weight. Moreover, the insulating panels are designed to be inserted from both the top and the bottom of the block. This slows down the construction process, if the blocks are insulated in the field. It adds to the cost of installation if the insulation is added at the factory. U.S. Pat. No. 4,498,266 to Perreton teaches a cinder block that has a center channel to hold blocks of insulation. U.S. Pat. No. 4,745,720 to Taylor teaches a cinder block that is cut in two lengthwise. The split block is then reassembled with a special insulating channel in the center. Special clips are provided to secure the insulation within the block. U.S. Pat. Nos. 5,209,037 and 5,321,926 teach cinder blocks that have complex curves formed in them to receive insulation. Although these blocks provide improved insulating capabilities, the complex curve design increases cost and provides minimal hand holds for block placement. This makes construction more difficult and slow, which also drives up cost.

Finally, U.S. Pat. No. 4,841,707 to Nova teaches an alternative direction in block wall construction. As noted above, the problem with ordinary blocks is the transmission of cold and heat through the blocks themselves. The blocks above seek to break the transmission path. Another way to do this is to use a double wall. Such a wall has the outward appearance of an ordinary block wall, but has an outer block wall and an inner block wall that are connected by bracing. The space between the walls can be filled with insulating material to provide the best possible levels of insulation.

The problem with the Nova wall is that there are no blocks. Both walls are poured. Although this is an acceptable building method, it can be expensive, especially for residential type construction.

SUMMARY OF THE INVENTION

The instant invention solves all the problems with the prior art designs by combining the best of both worlds. It does not modify the webs of a cinder block to accept insulation, which can never totally isolate the thermal paths because there is always some part of the transmission path left. Nor does it use the design taught in cases such as the Perreton or Taylor blocks that use a block in which the insulation path may be completely broken, but one is left with a heavy block that has no convenient way to easily pick up and move it. Nor does it rely on a full double wall, which requires poured walls instead of block.

The instant invention uses a block type construction that has two cement block, or clay brick walls joined by plastic webs. This block then has the strength of a cinder block, but with much less weight. Moreover, the plastic webs provide a handle to permit easy handling and placement of the blocks. Because of the thermal characteristics of the plastic webs, when a wall is finished using these blocks, it has the characteristics of a true double wall construction. The blocks are filled with concrete on one side of the block and filled with insulation on the other side of the center (or central) form. This provides a structurally sound wall that is fully insulated.

The blocks can be full height or half height size and also come in corner configurations.

It is an object of this invention to produce a building block system that is fully insulated and provides no thermal paths from the outside of the wall to the inside of the wall.

It is another object of this invention to produce a building block system that is lightweight and easy to install in the field.

It is yet another object of this invention to produce a building block system that has full structural integrity and yet can be fully insulated.

DETAILED DESCRIPTION OF THE INVENTION

Figure 1:
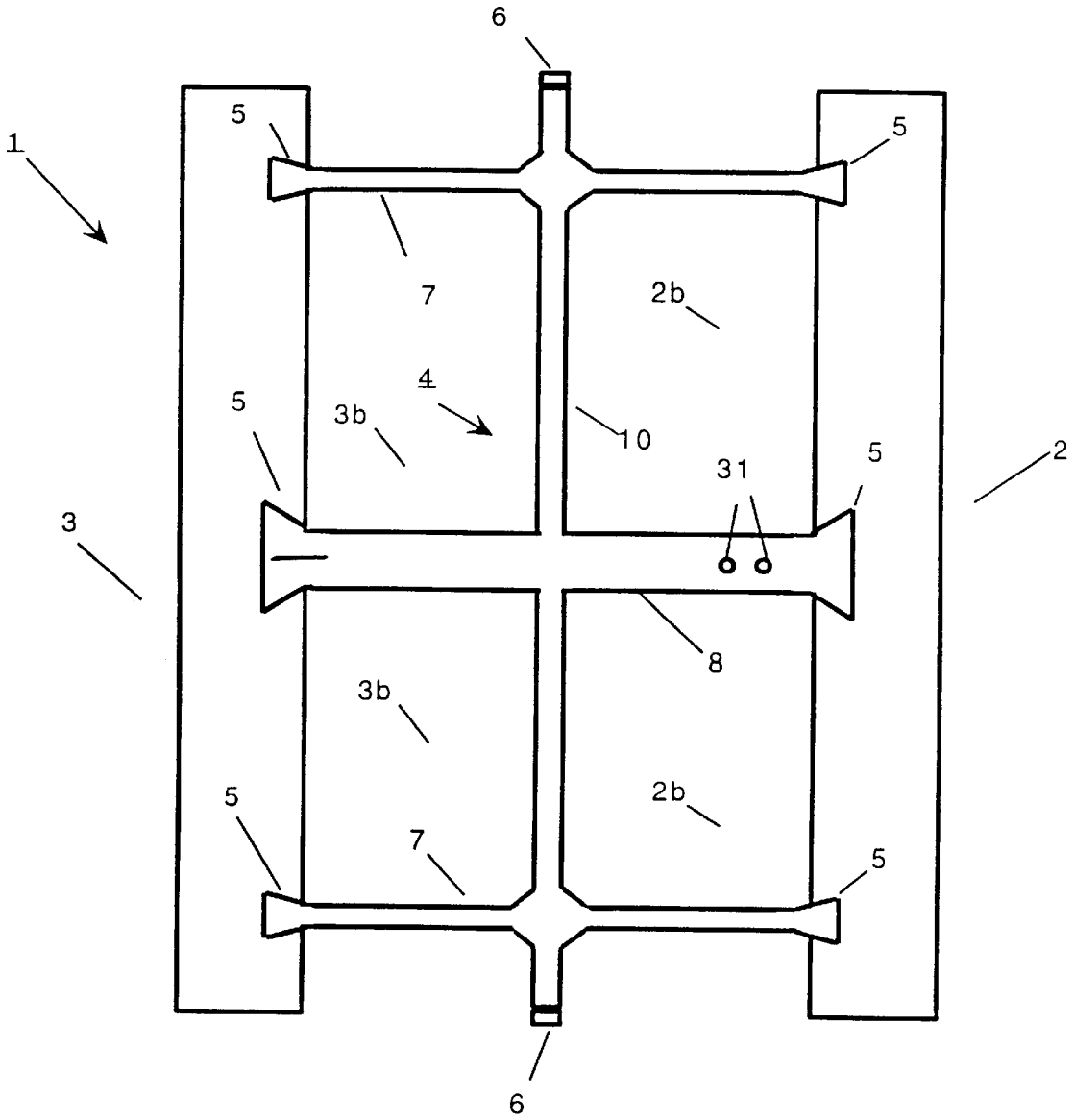
FIG. 1 is a top view of the first embodiment of the invention.
Figure 2:
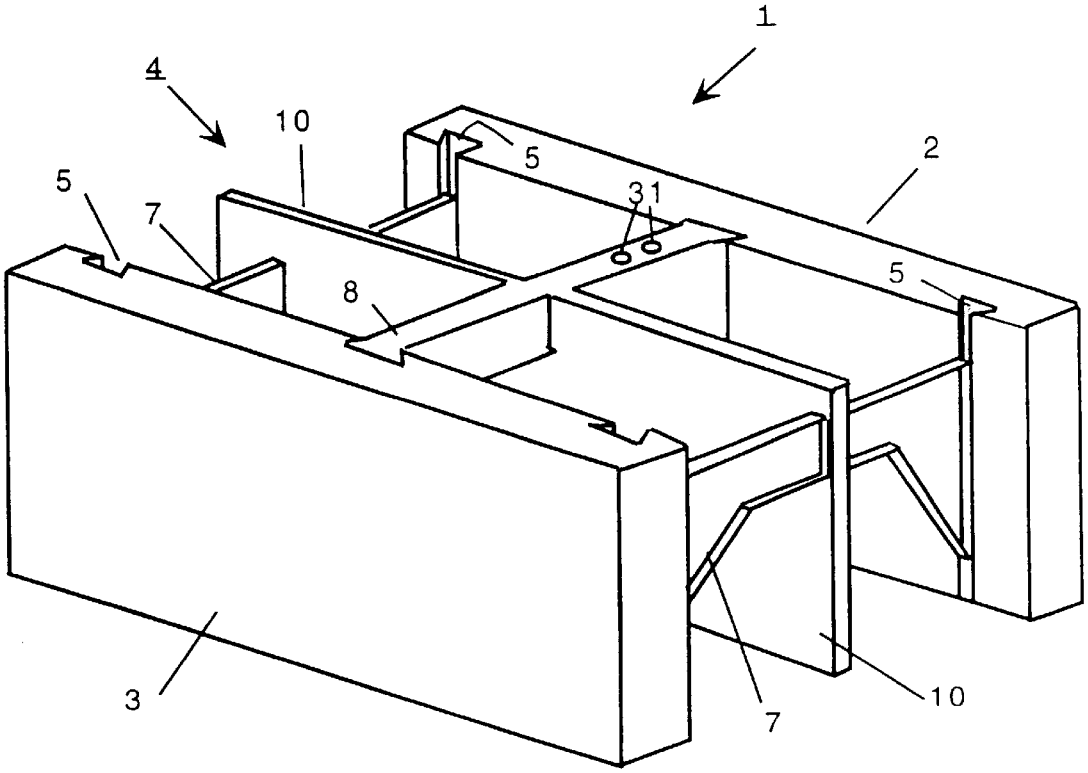
FIG. 2 is a perspective view of the first embodiment of the invention.

Referring now to FIG. 1, the top view of my new block 1 is shown. FIG. 2 is a perspective view of this embodiment. This block 1 has an outer wall 2, an inner wall 3 and a center plastic web 4. The outer wall 2 and the inner wall 3 can be made from cement, clay brick or similar materials. Both the outer wall 2, and inner wall 3 have identical forms. The web 4 has two end arms 7 and a center arm 8 as shown. The center arm 8 and end arms 7 are connected to a central form 10. These parts form an integral unit, which is called the web 4. As FIG. 1 shows, the central arm 8 is considerably thicker than the outer arms 7.

The inner and outer walls have a number of dovetail shaped grooves 5 to receive and hold the plastic web 4. In the preferred embodiment, three grooves 5 are used, as shown. Soft foam gaskets 6 are used to seal the plastic joints by filling the gaps created by mortar joints between the units (see, e.g., FIGS. 7 and 8).

With the web 4 in place, two cavities are formed between the outer wall 2, the center form 10 and the inner wall 3. The space between the outer wall 2 and the central form 10 is the outer cavity 2*b* and the space between the inner wall 3 and the central form 10 is called the inner cavity 3*b*.

Figure 1A:
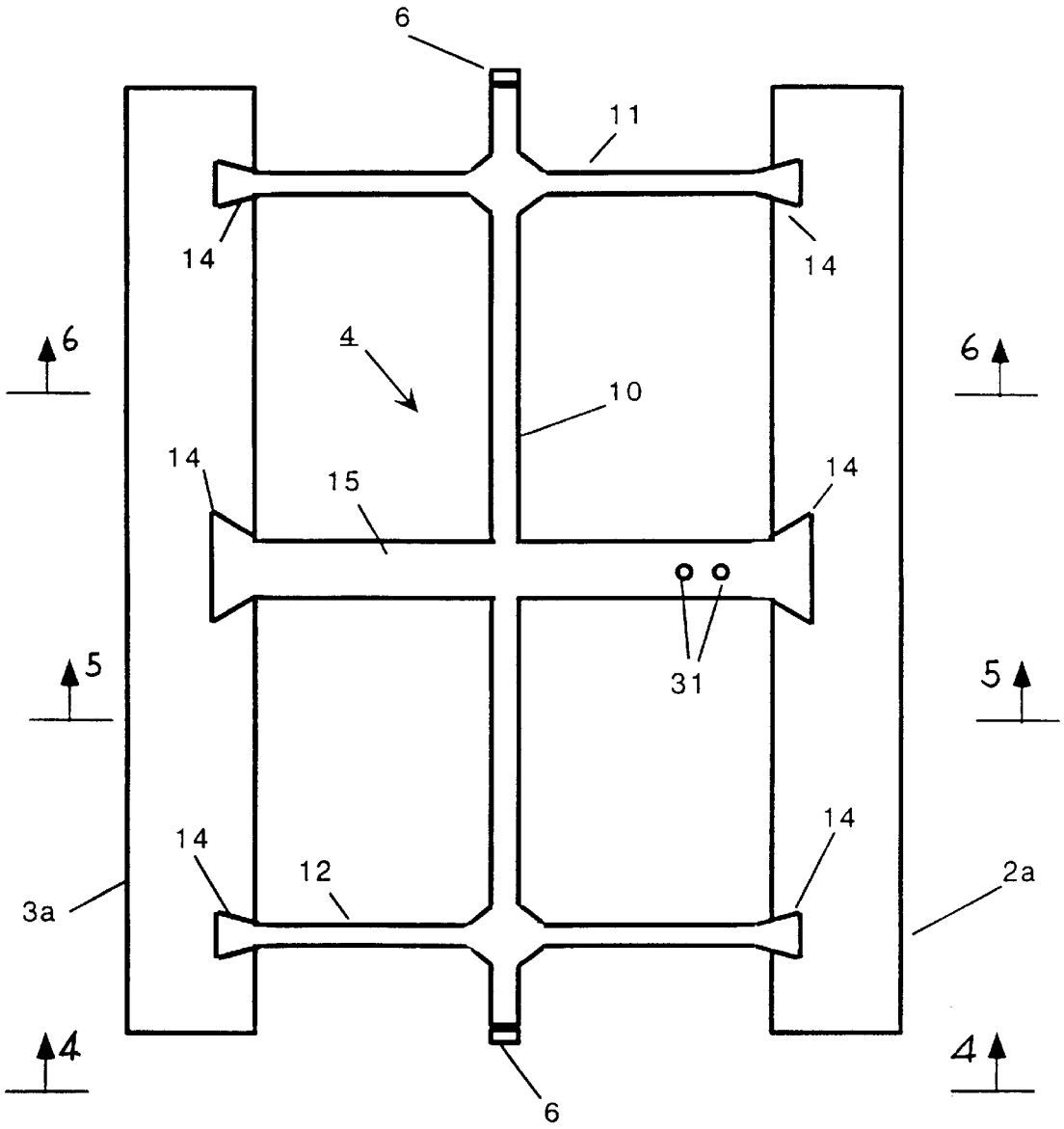
FIG. 1*a* is a top view of the half height embodiment of the invention.
Figure 5:
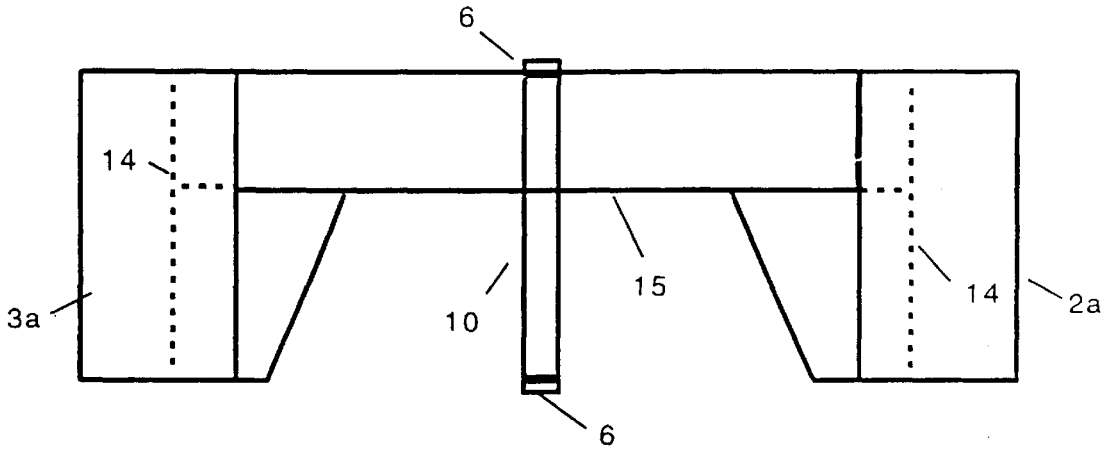
FIG. 5 is a detail cross-sectional view of a half-height block taken along the lines 5—5 of FIG. 1*a*.
Figure 6:
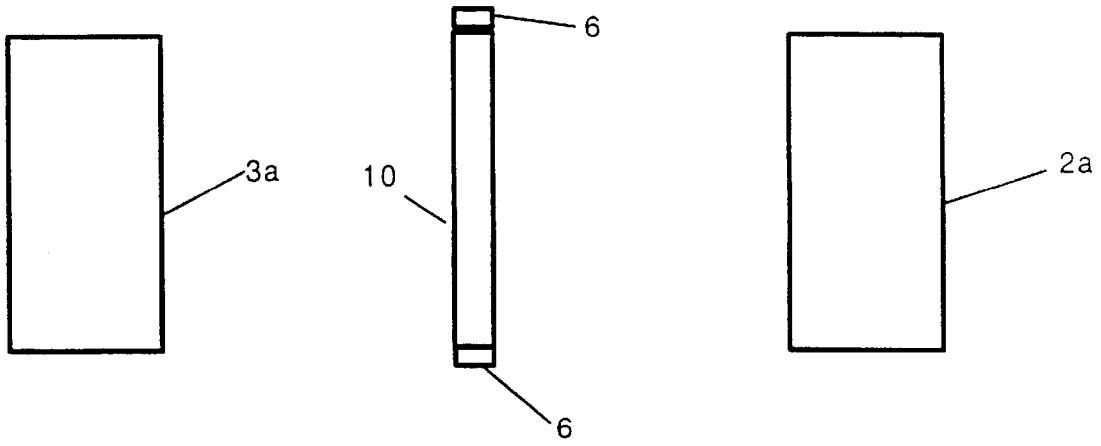
FIG. 6 is a detail cross-sectional view of a half-height block taken along the lines 6—6 of FIG. 1*a*.
Figure 7:
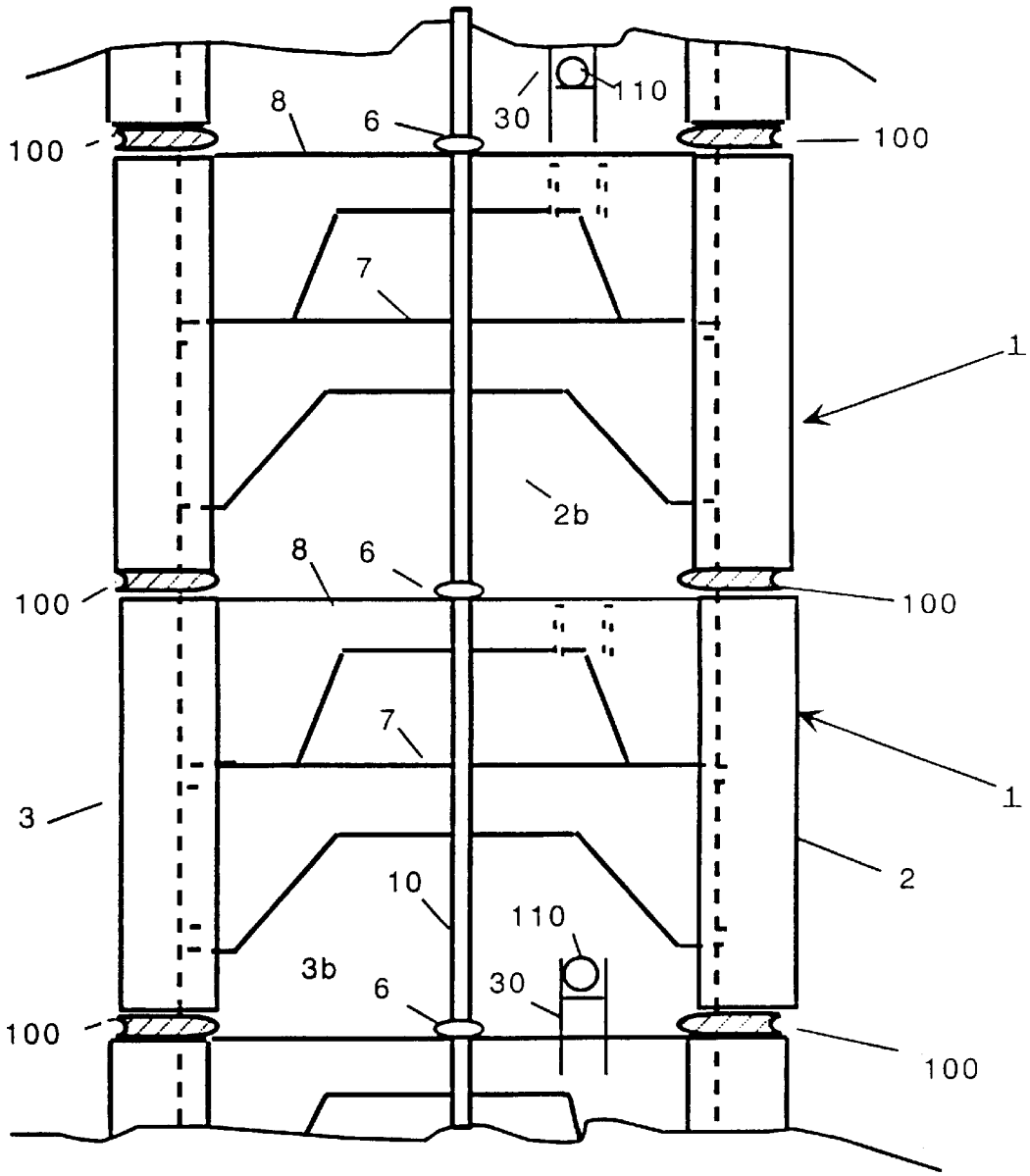
FIG. 7 is a side detail view of a number of blocks of the first embodiment, stacked to form a wall.

FIG. 1*a* is a top view of a half-height version of this embodiment. FIGS. 5, 6 and 7 are sectional views of the half-height embodiment. The only difference between these embodiments is the height of the wall. Also, the half-height units are primarily designed for clay brick walls to maintain a typically brick wall appearance.

The half-height blocks have an outer wall 2*a* and an inner wall 3*a* as shown. The plastic web 4 has a center form 10 as shown. Two end arms 11 and 12 extend outward from the center form 10 as shown. These arms 11 and 12 have corresponding dovetails 14 formed as shown. A center arm 15 is also used.

Figure 3:
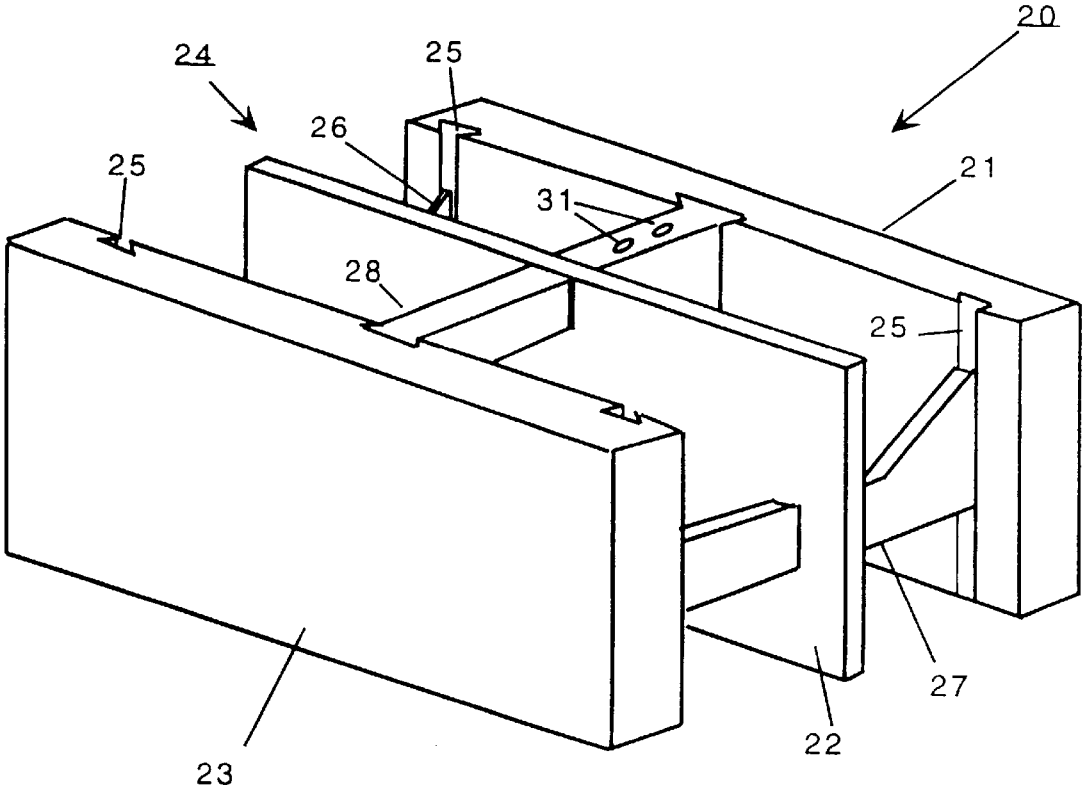
FIG. 3 is a perspective view of a second embodiment of the invention.

FIG. 3 is a perspective view of the second embodiment. This embodiment 20 also has an outer wall 21, an inner wall 23 and a plastic web 24. As in the case of the first embodiment, both the outer wall 21, and inner wall 23 have identical forms. Each wall has a number of dovetail shaped grooves 25 to receive and hold the plastic web 24. In this embodiment, three grooves are also used, as shown. The web 24 has a center form 22 as shown. The end arms 26 and 27 have flat bottoms and angled tops as shown. Between the end arms 26 and 27 a center arm 28 is also provided as shown. All the arms are connected to the center form 22. Note that in the first embodiment, the two end arms 11 and 12 have a lower angled portion and flat tops. In this embodiment, the end arms have flat bottoms and angled tops.

In all the embodiments, the center arm (8,15 or 28) is used as a handle for the blocks. Accordingly, the center arms (8, 15 or 28) have flat tops and are flush with the top surface of the inner and outer walls. This allows a worker to easily pick up and place the blocks by gripping the center arm.

Figure 4:
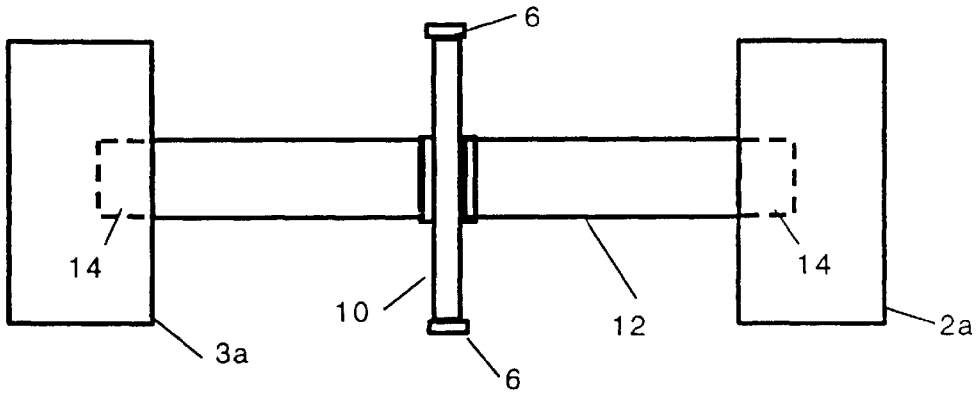
FIG. 4 is a detail cross-sectional view of a half-height block taken along the lines 4—4 of FIG. 1*a*.

Referring now to FIGS. 4, 5, and 6, details of the half-height blocks are shown. FIG. 4 is a cross section of a half-height block taken through the block showing an end arm. FIG. 5 is a cross section of the half-height block showing the center arm 15. FIG. 6 is a cross section of the halfheight showing the center portion of the web 4.

Figure 8:
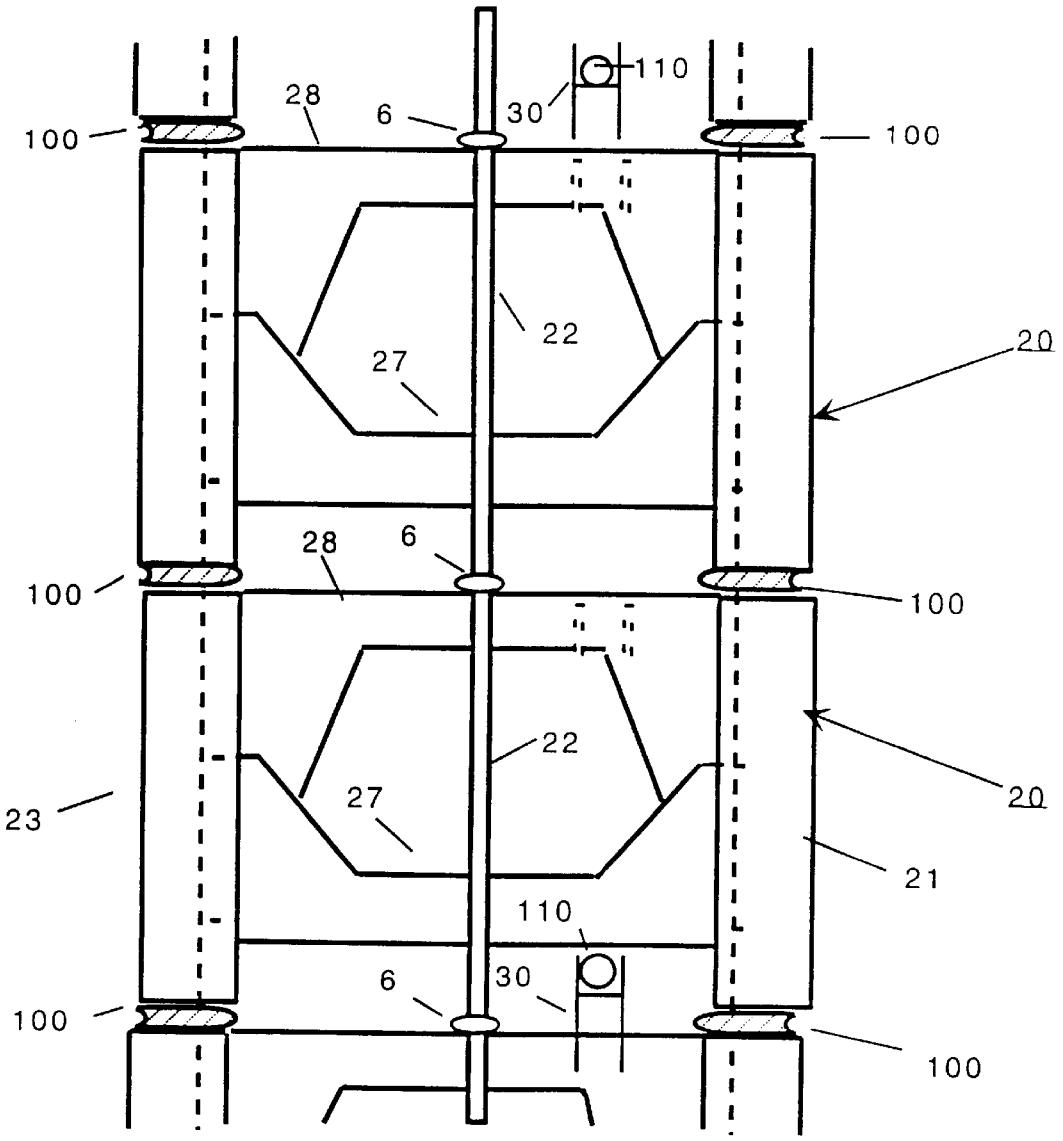
FIG. 8 is a side detail view of a number of blocks of the second embodiment, stacked to form a wall.

Referring now to FIGS. 7 and 8, details of a typical block wall assembly are shown. FIG. 7 is a side view of a section of wall formed by the blocks 1 of the first embodiment. The blocks 1 are stacked as shown. Mortar 100 is applied to the outer walls to form a tight joint between the blocks 1 as shown. Foam gaskets 6, or other types of sealer are applied to the center portions 10 of the webs 4. These gaskets effectively seal the gap between the webs 4 of the blocks 1.

Once the blocks are set in place, a structure of reinforcing bars (rebar) 110 is placed in the outer wall section. The rebar is set on wire supports 30 that are placed in holes 31 formed in the center arm. See FIGS. 1, 7 and 8. Once the rebar 110 is in place, the outer cavity 2*b* of the block can then be filled with concrete to make a solid wall structure. The inner cavity 3*b* of the block 1 is filled with insulation. In this way, the blocks 1 form a solid wall structure that is fully insulated.

FIG. 8 shows a wall segment made up of blocks 1 using the second embodiment web structure. It is assembled in an identical manner as the first embodiment. Except for the different web design, there is no difference in assembling a wall using the blocks of the second embodiment.

In both embodiments, the webs 4 are made of high strength plastic, or similar materials. It is important that the web 4 material be lightweight. The web 4 material must also be as thermally inert (i.e., non conductive) as possible. Although the webs 4 can be made of lightweight metal, the thermal characteristics of metal are such that too much heat would flow through.

Figure 9:
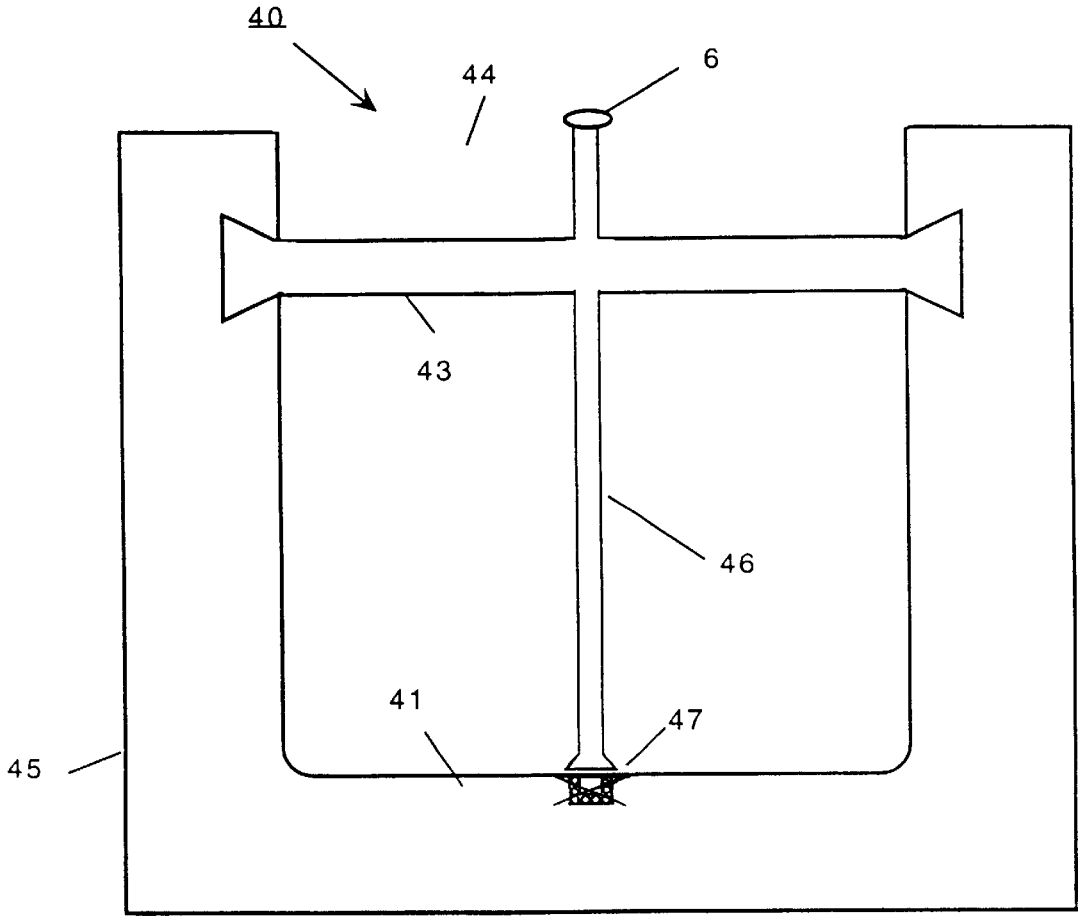
FIG. 9 is a top view of a half-length unit with a solid masonry jamb end.

Referring now to FIGS. 9–14, a number of specialty blocks are shown. These blocks can be full height or half height, depending on the look desired. In all cases, construction is the same as before, only the shape of the blocks and placement of the webs is altered, FIG. 9 shows a half-length block 40 that has a solid masonry jamb end 41. As shown, the web 42 has a single arm 43, which is positioned near the open end 44 of the block. Instead of two unconnected walls, this unit has a continuous outer wall as shown 45. The center form 46 is embedded into the masonry jamb end 41 as shown, and is surrounded by foam insulation 47.

Figure 10:
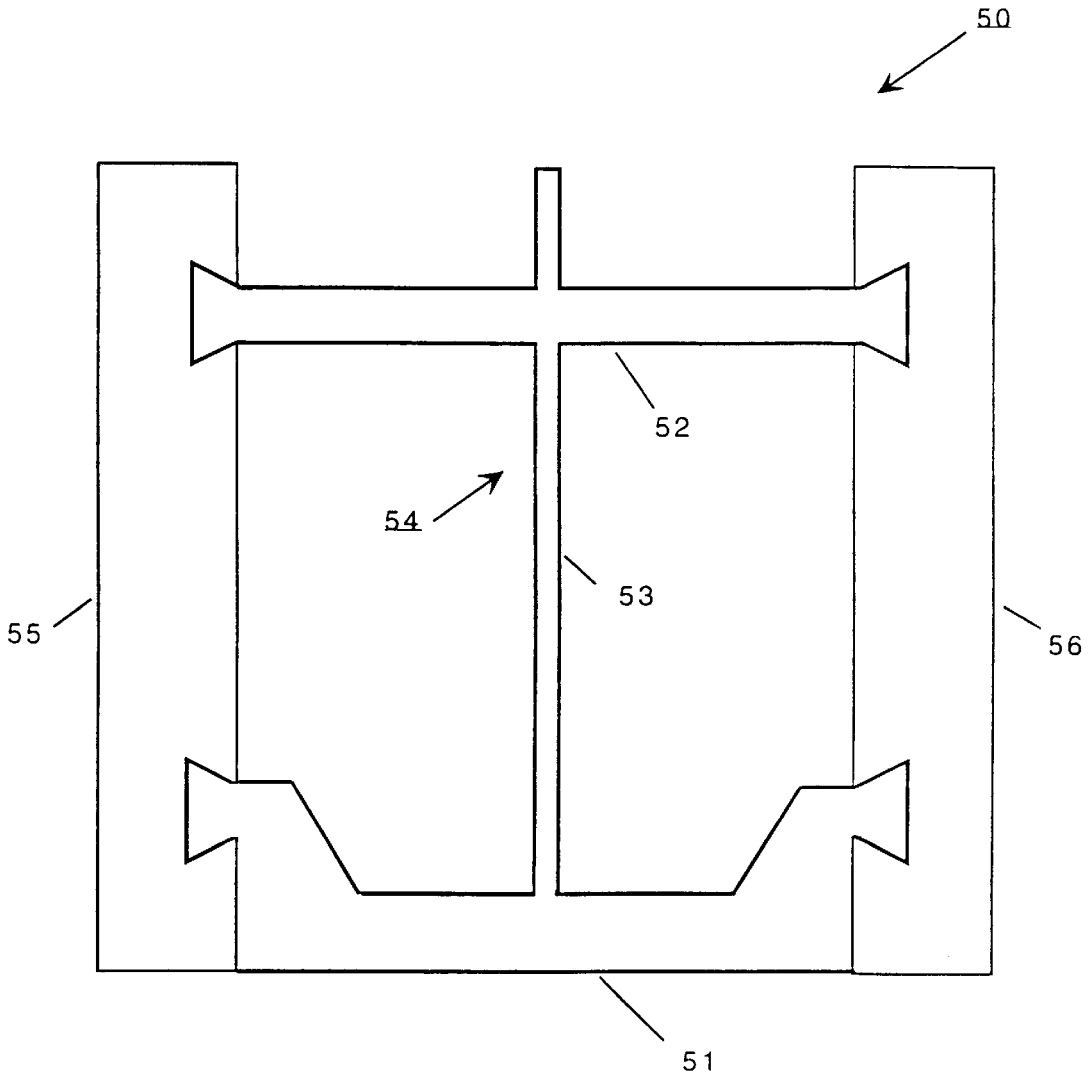
FIG. 10 is a top view of a half-length unit with a solid plastic jamb end.

FIG. 10 shows a half-length block 50 that has a solid plastic arm end 51. A second arm 52 is placed in the block as shown. A center form 53 is also provided. All the arms are connected to form a one piece web 54. Two masonry walls 55 and 56 are also provided.

Figure 11:
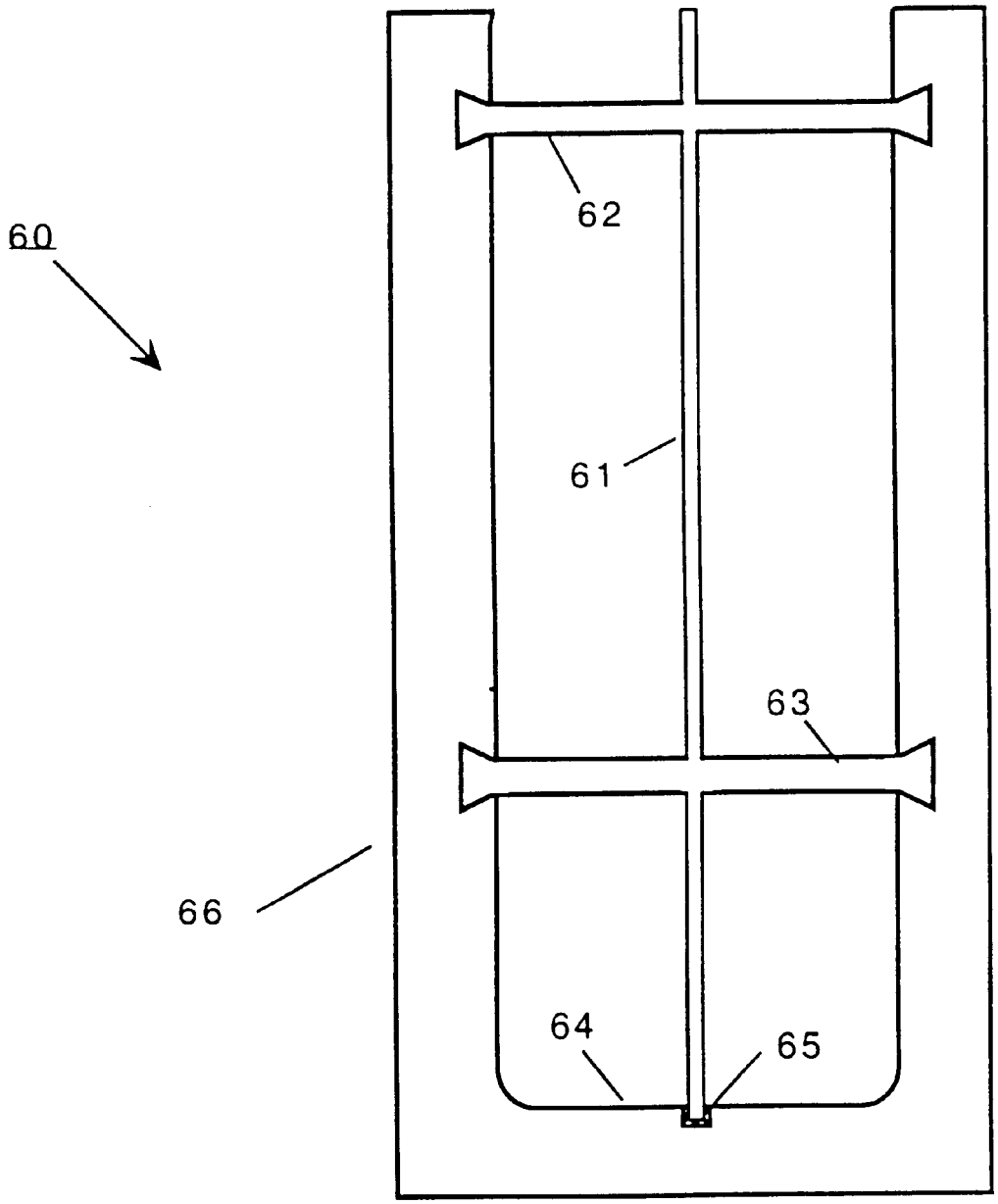
FIG. 11 is a top view of full-length unit with a solid masonry jamb end.

FIG. 11 is a full-length version of the embodiment of FIG. 9. This block 60 has a center form 61, and two arms 62 and 63 as shown. As in the block of FIG. 9, the center form 61 is embedded into the masonry jamb end 64 as shown, and is surrounded by foam insulation 65. Here, there is a single length of masonry wall 66.

Figure 12:
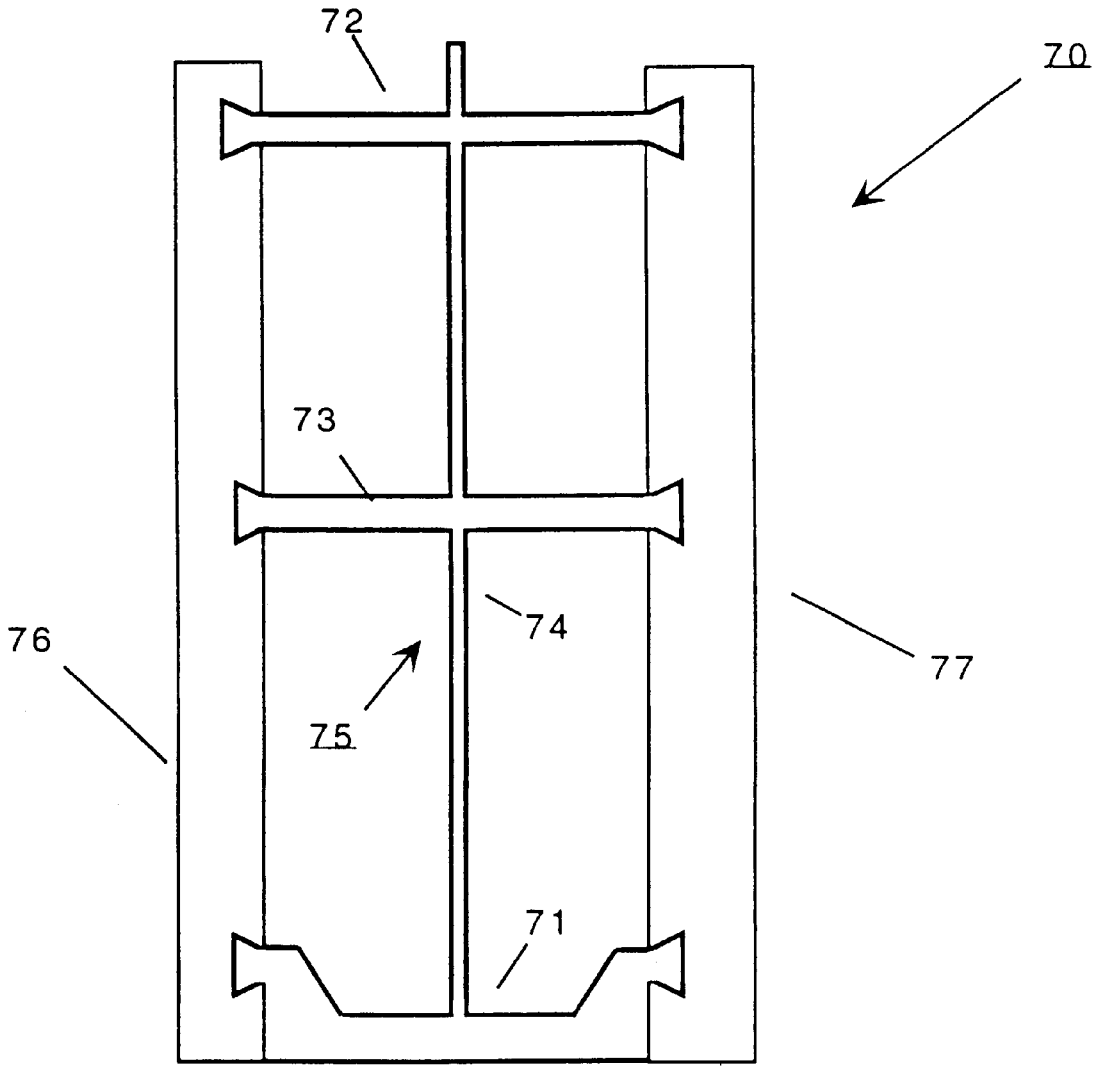
FIG. 12 is a top view of a full-length unit with a solid plastic jamb end.

FIG. 12 is a full-length version of the embodiment of FIG. 10. This block 70 has a solid plastic arm end 71. Two additional arms 72 and 73 are placed in the block as shown.

A center form 74 is also provided. All the arms are connected to form a one piece web 75. Two masonry walls 76 and 77 are also provided.

Figure 13:
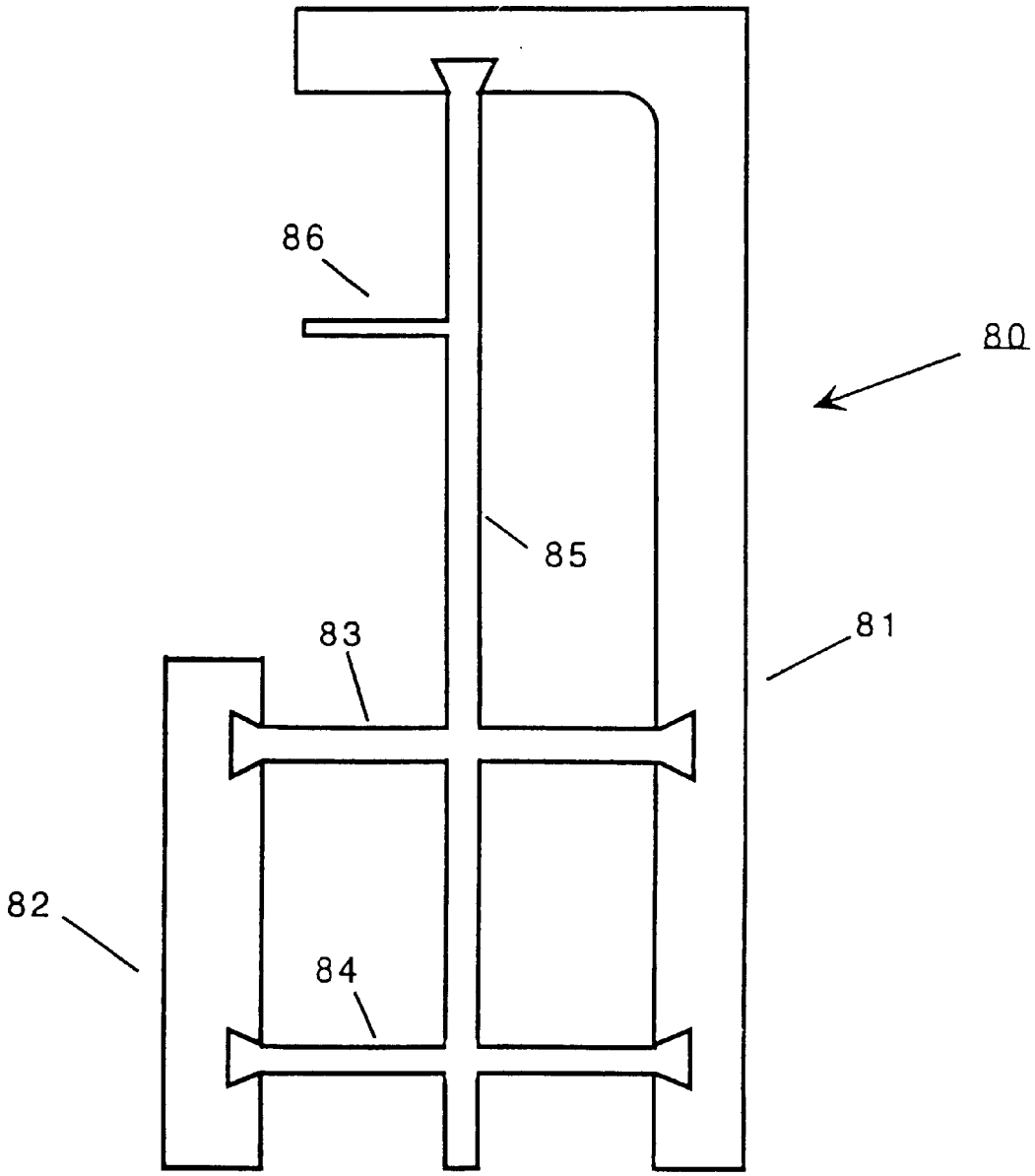
FIG. 13 is a top view of corner unit.

FIG. 13 is a top view of a typical comer unit 80. This unit is designed to present an outer corner that preserves a stylistic surface. This block 80 has a curved outer wall 81, and a short inner wall 82. The walls 81 and 82 are connected by two arms 83 and 84. A center form 85 is configured as shown. A connector arm 86 is also provided. It extends from the center form 85 as shown. The connector arm 86 is used to connect to a wall block 1 as part of the overall wall as shown in FIG. 14.

Figure 14:
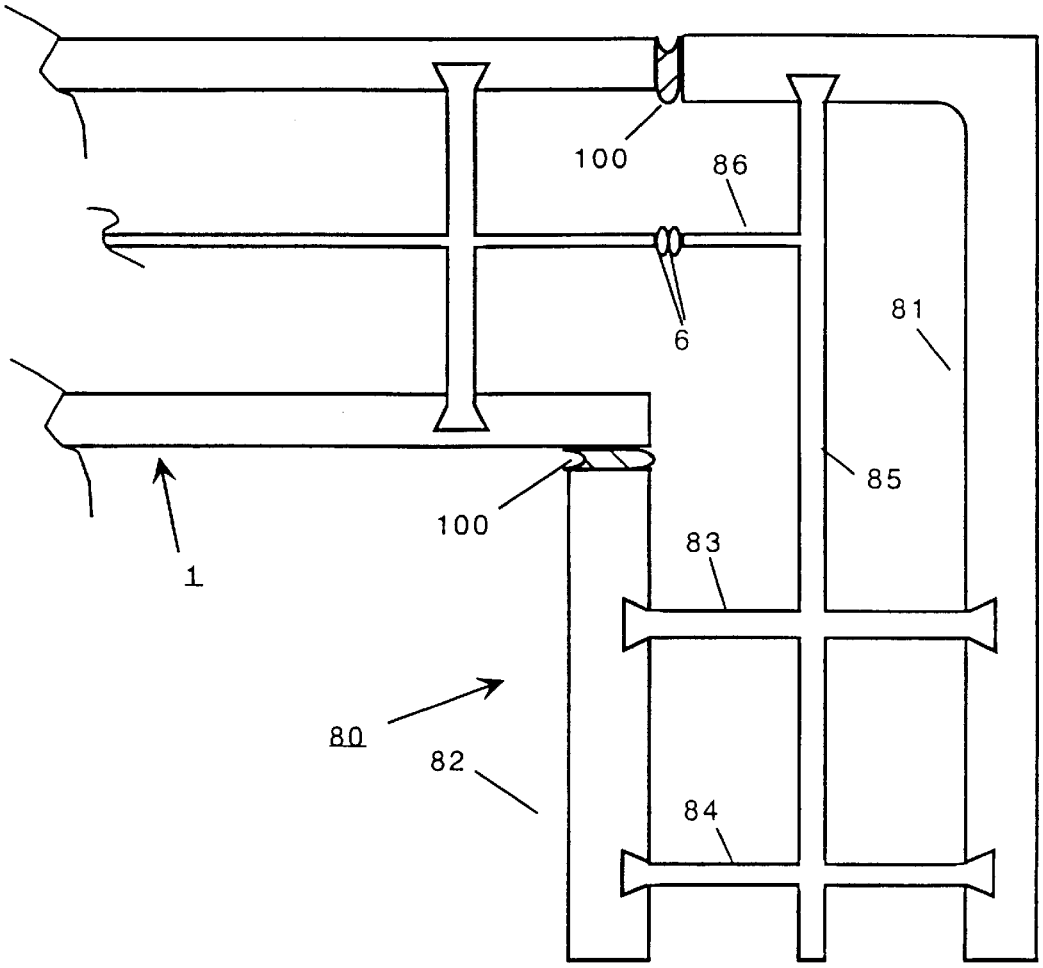
FIG. 14 is a top view of a typical comer connection.

FIG. 14 shows how the corner unit 80 is connected to a standard block 1. The placement of these blocks alternates with each course of blocks. The mortar joints 100 are placed as shown. Two foam pads 6 are provided to connect the center form 10, for example of block 1 to the connector arm 86 of the corner block 80 as shown. Of course, the corner block 80 can be made half-height to accommodate the other half-height designs.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A discrete block unit for wall construction comprising:

a) an outer wall;

b) an inner wall;

c) an internal web of substantially thermally inert material joining the inner and outer walls into a discrete block unit, wherein said internal web has a generally planar center portion, extending between, substantially parallel to and generally edge-aligned with said outer and inner walls, and said center portion has projecting therefrom a plurality of arms extending toward the inner and outer walls, said arms providing a thermal conduction path of limited cross-section relative to the area of the inner and outer walls;

d) means for fixedly securing at least one of said plurality of arms to said outer wall; and e) means for fixedly securing at least one of said plurality of arms to said inner wall, whereby the internal web joins the outer and inner walls via a low thermal conductivity physical link to form a discrete block unit for stacking with and mortar-joining to other like block units to form a wall partitioned by adjacent center portions of adjacent discrete block units into a first cavity and second cavity.

2. The block unit of claim 1 wherein said internal web is an integral unit formed of said substantially thermally inert material.

3. The block unit of claim 1 wherein said first cavity is adapted to receive an insulating material.

4. The block unit of claim 1 wherein said second cavity is adapted to receive concrete.

5. The block unit of claim 4 wherein the second cavity also is adapted to receive a plurality of reinforcing bars placed therein.

6. The block unit of claim 1 wherein at least one of said plurality of arms has a top profile permitting the internal web to be gripped by hand and used as a handle for moving the block unit.

7. The block unit of claim 1 wherein said outer wall and inner wall are generally rectangular forms.

8. The block unit of claim 7 wherein the material used to make the generally rectangular forms is selected from the group consisting of concrete, cement, and clay brick.

9. The block unit of claim 7 wherein said generally rectangular forms have a first end and a second end; and further such that said internal web includes an arm member that is fixedly attached to an end wall that connects the respective first ends of said generally rectangular forms.

10. The block unit of claim 7 whereby the generally rectangular forms are connected by two of said plurality of arms that together form a U-shaped member corresponding generally in height to the generally rectangular forms.

11. The block unit of claim 7 wherein the means for fixedly securing said at least one of the plurality of arms to said inner wall and the means for fixedly securing said at least one of the plurality of arms to said outer wall comprise a plurality of grooves formed in said generally rectangular forms.

12. The block unit of claim 11 wherein at least one of the plurality of grooves formed in said generally rectangular forms has a dovetail shape, and further wherein said at least one of the plurality of arms has an end with a corresponding dovetail shape such that said at least one of the plurality of arms interlocks with a corresponding one of said plurality of grooves when the end of said at least one of the plurality of arms is placed within said corresponding one of said plurality of grooves.

13. A discrete building block unit for forming corners in a wall comprising:

a) an outer wall, said outer wall having a generally rectangular body and having a length, and a front end, wherein said front end is a perpendicular wall that forms a corner face that extends for a distance and ends at a leading edge;

b) an inner wall, being generally rectangular and having a back end and a front end, whereby said inner wall has a length shorter than the length of said outer wall and whereby said front end of said inner wall is substantially aligned with the leading edge of said corner face of said outer wall;

c) an internal web of substantially thermally inert material joining the inner and outer walls into a discrete block unit, wherein said internal web has a generally planar center portion extending substantially parallel to the lengths of said outer and inner walls, and said center portion has projecting therefrom a plurality of arms extending toward the inner and outer walls, said arms providing a thermal conduction path of limited cross-section relative to the area of the inner and outer walls;

d) means for fixedly securing at least one of said plurality of arms to said outer wall; and e) means for fixedly securing at least one of said plurality of arms to said inner wall, whereby the internal web joins the outer and inner walls via a low thermal conductivity physical link to form a discrete block unit for stacking with and mortar-joining to other block units to form a wall corner partitioned by adjacent center portions of adjacent discrete block units into a first cavity and second cavity.

14. The building block unit of claim 13 wherein said internal web is an integral unit formed of said substantially thermally inert material.

15. The building block unit of claim 13 wherein said first cavity is adapted to receive an insulating material.

16. The building block unit of claim 13 wherein said second cavity is adapted to receive concrete.

17. The building block unit of claim 16 wherein the second cavity also is adapted to receive a plurality of reinforcing bars placed therein.

18. The building block unit of claim 13 wherein at least one of said plurality of arms has a top profile permitting the internal web to be gripped by hand and used as a handle for moving the building block unit.

19. The building block unit of claim 13 wherein the material used to make the inner wall and the outer wall is selected from the group consisting of concrete, cement, and clay brick.

20. A method of forming a discrete block unit for wall construction comprising:

(a) providing an outer wall;

(b) providing an inner wall;

(c) providing an internal web of substantially thermally inert material for joining the inner and outer walls into a discrete block unit, wherein said internal web has a generally planar center portion, extending substantially parallel to and aligned with said outer and inner walls, and said center portion has projecting therefrom a plurality of arms extending toward the inner and outer walls, said arms providing a thermal conduction path of limited cross-section relative to the area of the inner and outer walls;

(d) fixedly securing at least one of said plurality of arms to said outer wall; and (e) fixedly securing at least one of said plurality of arms to said inner wall, whereby the internal web joins the outer and inner walls via a low thermal conductivity physical link to form a discrete block unit for stacking with and mortar-joining to other like block units to form a wall partitioned by adjacent center portions of adjacent block units into a first cavity and second cavity.

21. The method of claim 20 further comprising the act of substantially filling the first cavity with insulating material, after a plurality of block units has been formed into a wall.

22. The method of claim 20 further comprising the act of substantially filling the second cavity with concrete, after a plurality of block units has been formed into a wall.

23. The method of claim 20 further comprising the act of placing reinforcing bars in the second cavity, after a plurality of block units has been formed into a wall and before the second cavity is filled with concrete.

24. The method of claim 20 wherein the step of providing an outer wall comprises providing an outer wall made of material selected from the group consisting of concrete, cement, and clay brick.

25. The method of claim 20 wherein the step of providing an inner wall comprises providing an inner wall made of material selected from the group consisting of concrete, cement, and clay brick.

26. The method of claim 20 wherein the step of providing an internal web comprises providing an internal web that is an integral unit made of said material that is substantially thermally inert.

27. A method of constructing a wall comprising:

(a) providing a plurality of discrete block units, each comprising (i) an outer wall;

(ii) an inner wall;

(iii) an internal web of substantially thermally inert material joining the inner and outer walls via a low thermal conductivity physical link into a discrete block unit, wherein said internal web has a generally planar center portion, extending substantially parallel to and aligned with said outer and inner walls, and said center portion has projecting therefrom a plurality of arms extending toward the inner and outer walls, said arms providing a thermal conduction path of limited cross-section relative to the area of the inner and outer walls;

(b) for each block unit, (i) fixedly securing at least one of said plurality of arms to said outer wall; and (ii) fixedly securing at least one of said plurality of arms to said inner wall, whereby the internal web joins the outer and inner walls to form a discrete block unit; and (c) stacking and mortar-joining a plurality of like block units to form a wall partitioned by adjacent center portions of adjacent block units into a first cavity and second cavity.

28. The method of claim 27 further comprising the act of substantially filling the first cavity with insulating material, after the plurality of blocks has been formed into a wall.

29. The method of claim 27 further comprising the act of substantially filling the second cavity with concrete, after the plurality of blocks has been formed into a wall.

30. The method of claim 27 further comprising the act of placing reinforcing bars in the second cavity, after the plurality of blocks has been formed into a wall.

* * * * *